US006079338A

United States Patent [19]

Yeh

[11] Patent Number: 6,079,338

[45] Date of Patent: Jun. 27, 2000

[54] COLLAPSIBLE LEISURE TABLE

[76] Inventor: Chin-Chung Yeh, No. 27, Lane 297. Sec. 1. Pei Hsing R.D., Hsing Tien City, Taipei Hsien, Taiwan

[21] Appl. No.: 09/379,303

[22] Filed: Aug. 23, 1999

[51] Int. Cl.[7] ..... A47B 3/00

[52] U.S. Cl. ..... 108/115; 108/34

[58] Field of Search ..... 108/115, 116, 108/118, 157.1, 157.18, 158.12, 34

[56] References Cited

U.S. PATENT DOCUMENTS

| | | | |
|---|---|---|---|
| 361,279 | 4/1887 | Forssell | 108/34 |
| 557,045 | 3/1896 | Baxter | 108/34 X |
| 743,938 | 11/1903 | Sharkey | 108/34 |
| 1,295,194 | 2/1919 | Parelius | 108/34 |
| 2,023,870 | 12/1935 | Casott | 108/34 |
| 2,638,394 | 5/1953 | Ulrich | 108/34 |
| 3,462,773 | 8/1969 | Triplett | 108/115 X |
| 4,537,443 | 8/1985 | Bray | 108/34 X |
| 4,579,066 | 4/1986 | Zeigler | 108/115 X |
| 5,421,273 | 6/1995 | Lin | 108/34 X |
| 5,865,127 | 2/1999 | Carter | 108/115 |

*Primary Examiner*—Jose V. Chen

*Attorney, Agent, or Firm*—Pro-Tehctor International Services

[57] ABSTRACT

A collapsible leisure table mainly includes a collapsible support portion and a foldable tabletop. The support portion includes four telescopic legs each having an inner tube and an outer tube and four pairs of intersected and pivotally connected diagonal struts. Lower ends of the outer tubes and upper ends of the inner tubes of the telescopic legs as well as lower and upper ends of the diagonal struts are connected to four lower and four upper locating seats, respectively. Two links are pivotally connected at their respective one end to two diagonally opposite upper locating seats. The two links may be located in two long grooves provided on top surfaces of another two upper locating seats with their another right-angled ends firmly hooking to outer ends of the long grooves and thereby lock the diagonal struts in a fully extended and stably erected state. The tabletop is removably supported on the top of the support portion by engaging four protrusions below the tabletop with four holes provided on top surfaces of the upper locating seats. The tabletop can be folded into a hollow case for receiving the collapsed support portion therein, permitting the collapsed leisure table to be packed in a bag for convenient carriage and storage.

1 Claim, 5 Drawing Sheets

COLLAPSIBLE LEISURE TABLE

BACKGROUND OF THE INVENTION

The present invention relates to a collapsible leisure table, and more particularly to a table that can be either quickly collapsed for convenient storage and carriage or easily extended and assembled for use in outdoor leisure activities.

There are various kinds of products developed for outdoor leisure activities and very welcomed by general consumers. Among these products, there is a convenient and small-sized leisure table that is almost a must in all kinds of outdoor leisure activities. This type of leisure table usually includes a one-piece square or round tabletop, and several detachable legs. A user may easily assemble the legs to the tabletop to form the complete leisure table. However, the tabletop has an area that is large enough to prevent the table from being conveniently carried to different places for outdoor activities.

SUMMARY OF THE INVENTION

It is therefore a primary object of the present invention to provide a collapsible leisure table that includes a foldable tabletop and a collapsible support portion. The support portion includes for telescopic legs that each includes an inner tube slidably received in an outer tube, and four pairs of intersected and pivotally connected diagonal struts. Lower ends of the outer tubes and upper ends of the inner tubes of the telescopic legs, as well as lower and upper ends of the diagonal struts are connected to four lower and upper locating seats, respectively. Two links are pivotally connected at their respective one end to two diagonally opposite upper locating seats. The other two upper locating seats each has an inward extended portion provided at top surface thereof and has a long groove extended across each of the extended portion. The long groove each has a notch provided at an outer end thereof. The links may be separately brought to locate in the long grooves with their right-angled free heads firmly hooking at the notches and thereby lock the diagonal struts in a fully extended and stably erected state. The four upper locating seats are provided at their top surfaces each with a hole corresponding to four protrusions formed at bottom outer corners of the fully stretched tabletop. The tabletop may be firmly supported on the top of the support portion by engaging the bottom protrusions into the holes on the upper locating seats.

Another object of the present invention is to provide a collapsible leisure table that includes a foldable tabletop and a collapsible support portion. The support portion can be easily collapsed to occupy a very small space by inward pushing four pairs of intersected and pivotally connected diagonal struts. The tabletop includes four sequentially pivotally connected boards that can be folded to enclose a hollow space for holding the collapsed support portion therein, so that the whole collapsed leisure table may be packed in one single bag for convenient storage and carriage.

BRIEF DESCRIPTION OF THE DRAWINGS

The novel features of the present invention may be best understood by referring to the following detailed description of the preferred embodiment and the accompanying drawings, wherein.

DETAILED DESCRIPTION OF THE PREFERRED EMBODIMENT

Figure 1:
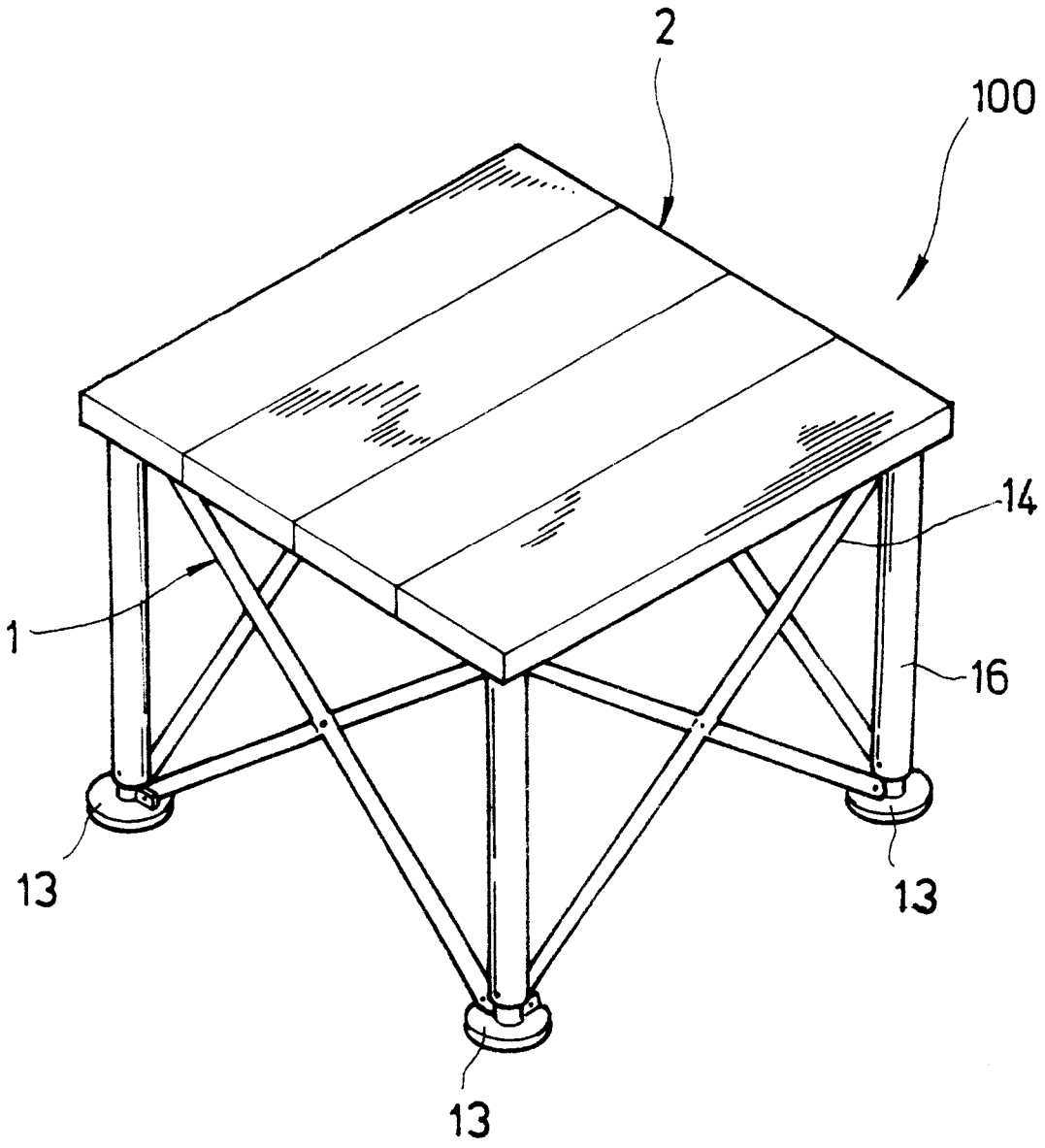
FIG. 1 is a perspective of a collapsible leisure table according to the present invention in a fully extended state.
Figure 2:
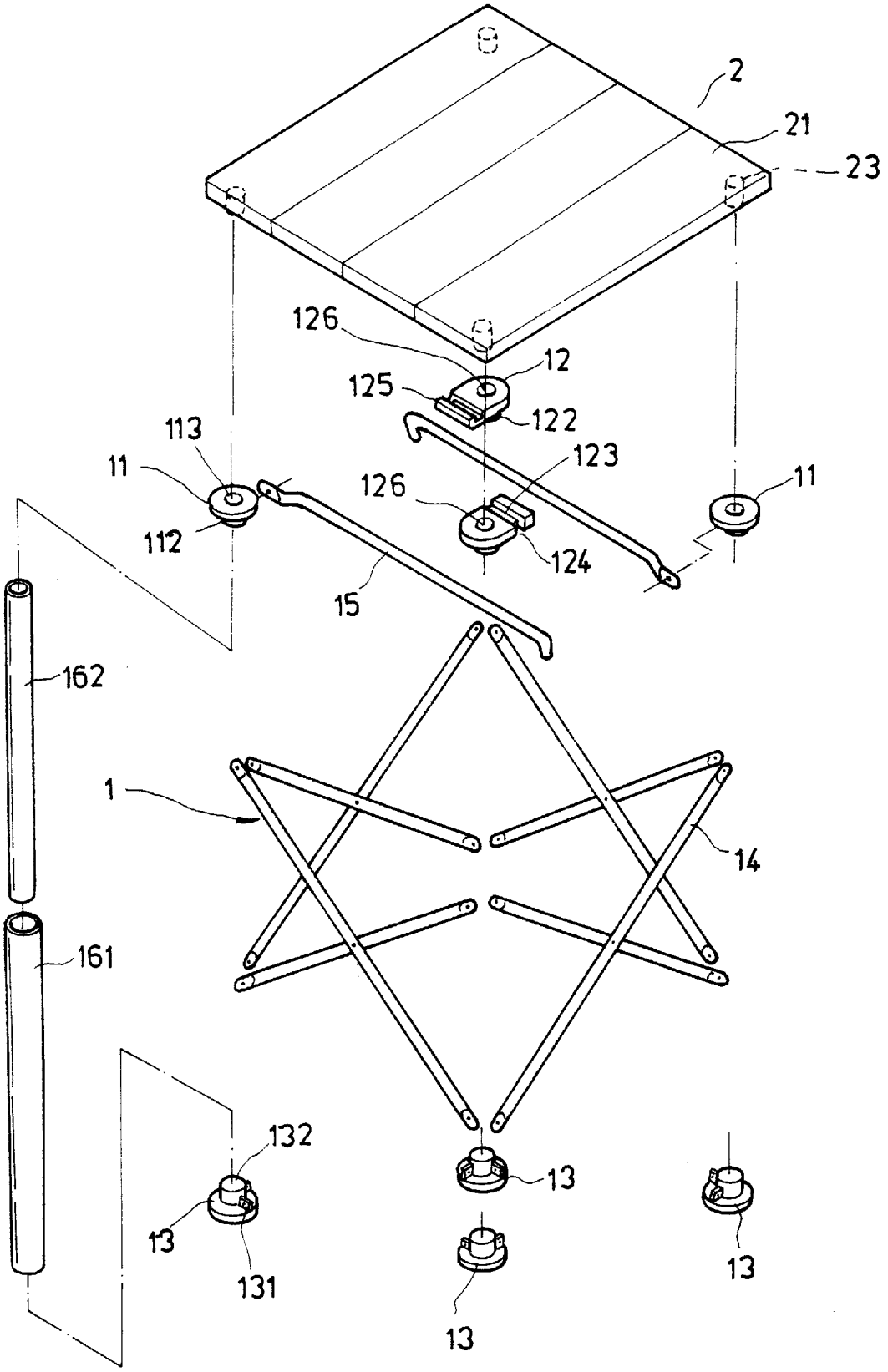
FIG. 2 is an exploded perspective of the collapsible leisure table of FIG. 1.
Figure 3:
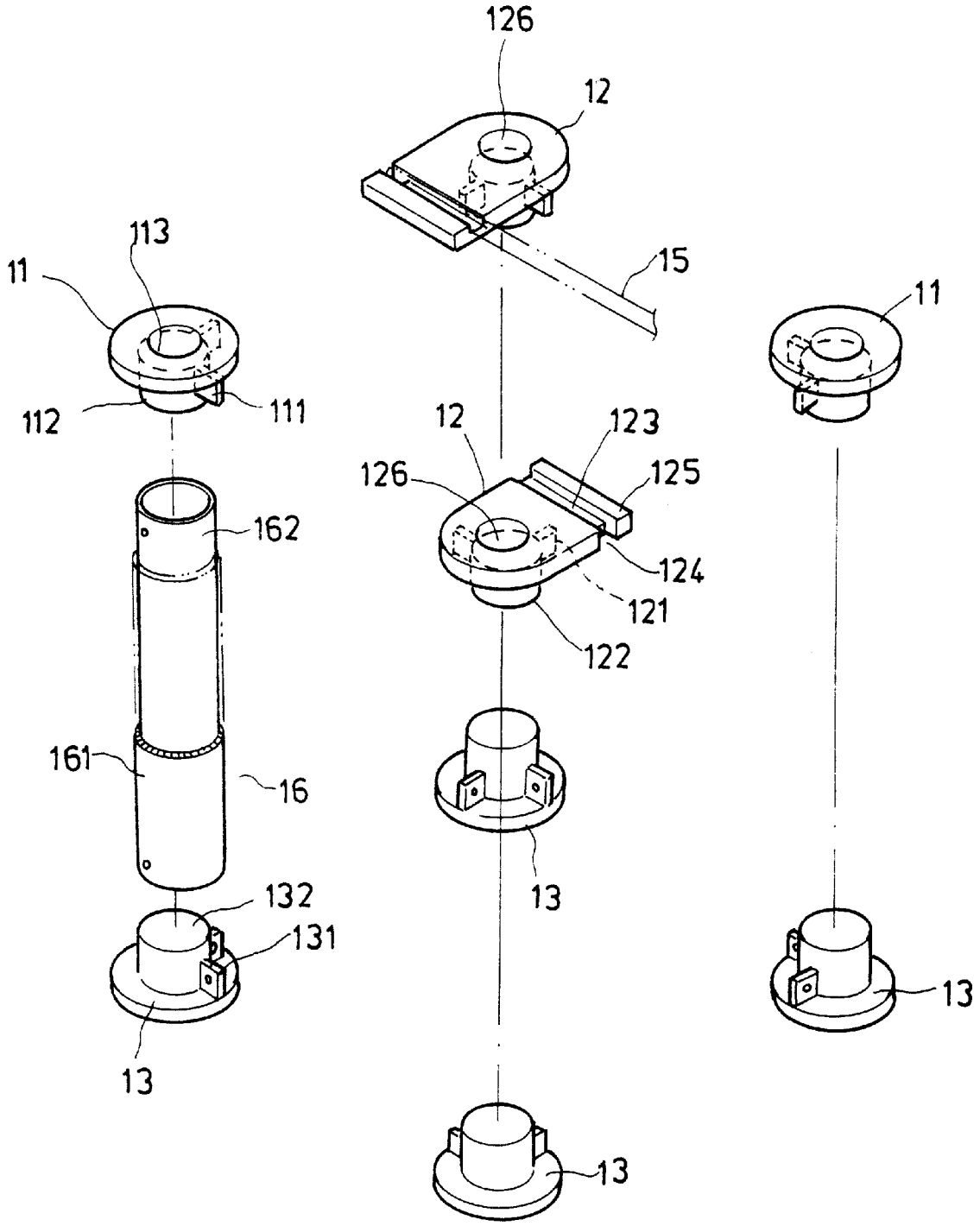
FIG. 3 illustrates the structure of the locating seats of the collapsible leisure table of FIG. 1.

Please refer to FIGS. 1, 2 and 3 at the same time. A collapsible leisure table 100 according to the present invention mainly includes a support portion 1 and a tabletop 2.

The support portion 1 includes two pairs of upper locating seats 11 and 12, four lower locating seats 13, four pairs of intersected and pivotally connected diagonal struts 14, two links 15, and four telescopic legs 16. The two upper locating seats 11 or 12 in each pair are diagonally opposite to one anther. The upper locating seats 11, 12 and the lower locating seats 13 are provided at bottom surfaces and top surfaces, respectively, each with a raised portion 112, 122, 132 and a right-angled bracket 111, 121, 131 projected from outer periphery of the raised portions 112, 122, 132. The upper locating seats 11, 12 are further provided at their top surfaces each with an engaging hole 113, 126, respectively. Moreover, the upper locating seats 12 each has an inward extended portion 125 (that is, a portion of the locating seat 12 that is distant from a corner of the tabletop 2 when the leisure table is in an extended state) with a long groove 123 extended across an outer edge of each the extended portion 125. A notch 124 is formed on each long groove 123 at their outer end (that is, an end of the groove 123 adjacent to an edge of the tabletop 2). The link 15 each has a first end that has a small length being slightly downward bent and is pivotally connected to the right-angled bracket 111 of the upper locating seats 11. A second end of each the link 15 is downward bent by 90 degrees to form a right-angled head that is adapted for hooking to the notch 124 on the upper locating seat 12.

The diagonal struts 14 are divided into four pairs. Each pair of the diagonal struts 14 intersect with one another and are pivotally connected at their intersection. The diagonal struts 14 are connected at their upper ends to the right-angled brackets 111, 121 on the upper locating seats 11, 12 and at their lower ends to the right-angled brackets 131 on the lower locating seats 13, such that they can be either fully extended or collapsed without separating from one another.

The telescopic legs 16 each includes an outer tube 161 and an inner tube 162 telescopically received in the outer tube 161. The upper ends of the inner tubes 162 are connected to the raised portions 112, 122 at lower side of the upper locating seats 11, 12, and the lower ends of the outer tubes 161 are connected to the raised portions 132 of the lower locating seats 13.

Figure 4:
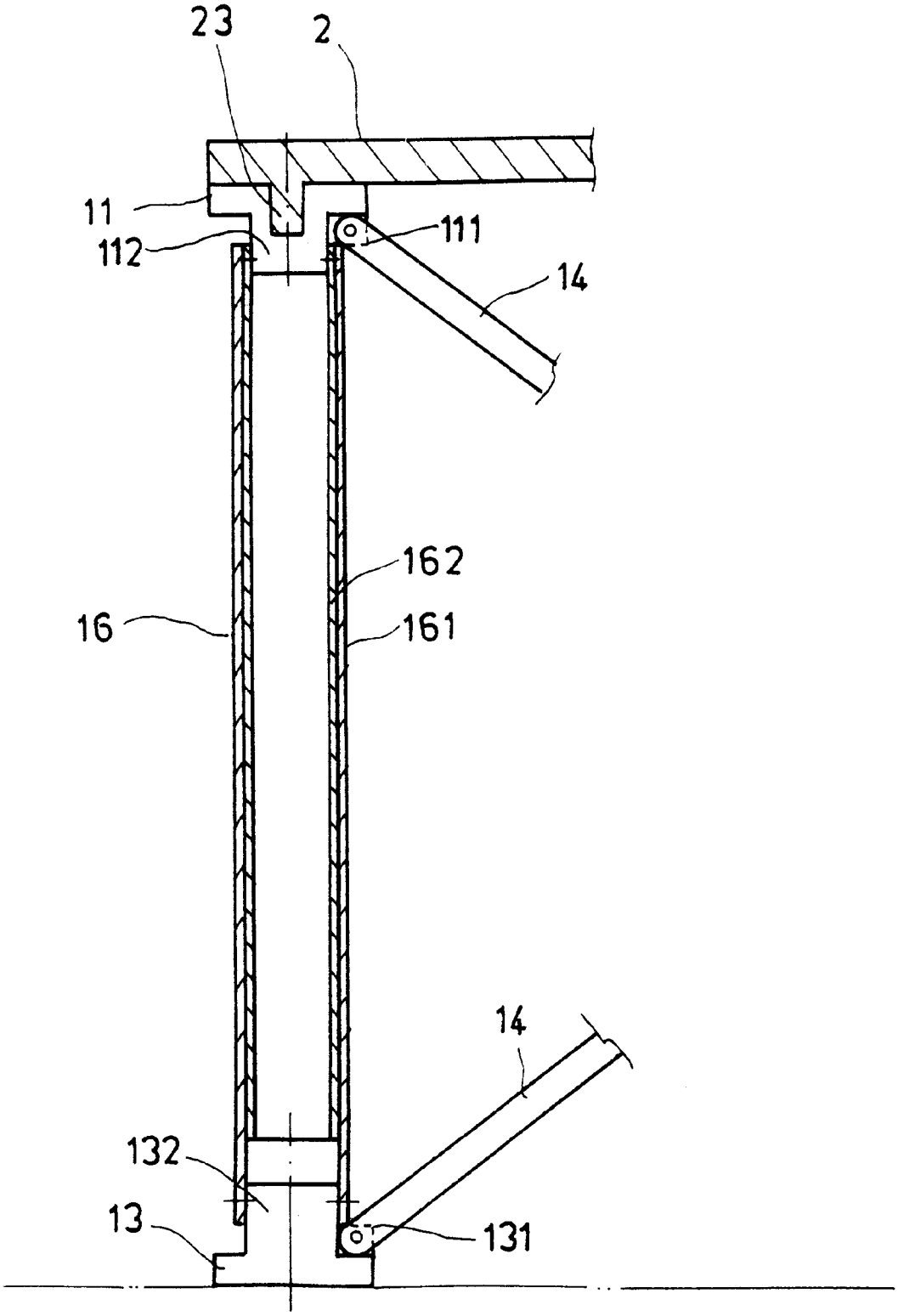
FIG. 4 is a fragmentary sectional view showing the manner in which the telescopic legs and the diagonal struts of the collapsible leisure table of FIG. 1 are connected to the upper and the lower locating seats.

By fully extending the four pairs of pivotally connected diagonal struts 14, the inner tubes 162 are automatically pulled downward into the outer tubes 161 of the telescopic legs 16 for the outer tubes 161 to extend between the upper seats 11, 12 and the lower seats 13 (see FIG. 4). At this point, by locating the two links 15 in the long grooves 123 on the top surfaces of the upper locating seats 12 with their right-angled heads at the second ends firmly hooked at the notches 124, the diagonal struts 14 and accordingly, the whole support portion 1 can be firmly locked in a stably erected state.

The tabletop 2 includes four pieces of sequentially and pivotally connected boards. These four boards may be stretched to a fully extended plane surface or folded to enclose a hollow space (see FIG. 5). Two boards 21 that are located at two outer sides of these four boards of the tabletop 2 are formed at outer corners of their bottom surfaces 22 with two engaging protrusions 23 corresponding to the engaging holes 113, 126 on the top surfaces of the upper locating seats 11, 12, respectively. When both the support portion 1 and the tabletop 2 are fully extended and the two links 15 are connected at their second ends to the notches 124 of the long grooves 123, the tabletop 2 may be positioned onto the support portion 1 with the engaging protrusions 23 engaged with the engaging holes 113, 126 in a tight fit relation to complete the assembling of the leisure table 100.

With the four pairs of diagonal struts 14 in a fully extended state, the two links 15 separately extended between two upper locating seats 11 and 12 and the right-angled heads of the links 15 firmly hooked at the notches 124 of the upper locating seats 12, and the engaging holes 113, 126 on the locating seats 11, 12 tightly engaged with the engaging protrusions 23 of the tabletop 2, the whole leisure table 100 can stand stably without swaying. And the telescopic legs 16 further support the tabletop 2 to prevent the latter from unexpected collapse due to any external force or heavy load on the tabletop 2.

Figure 5:
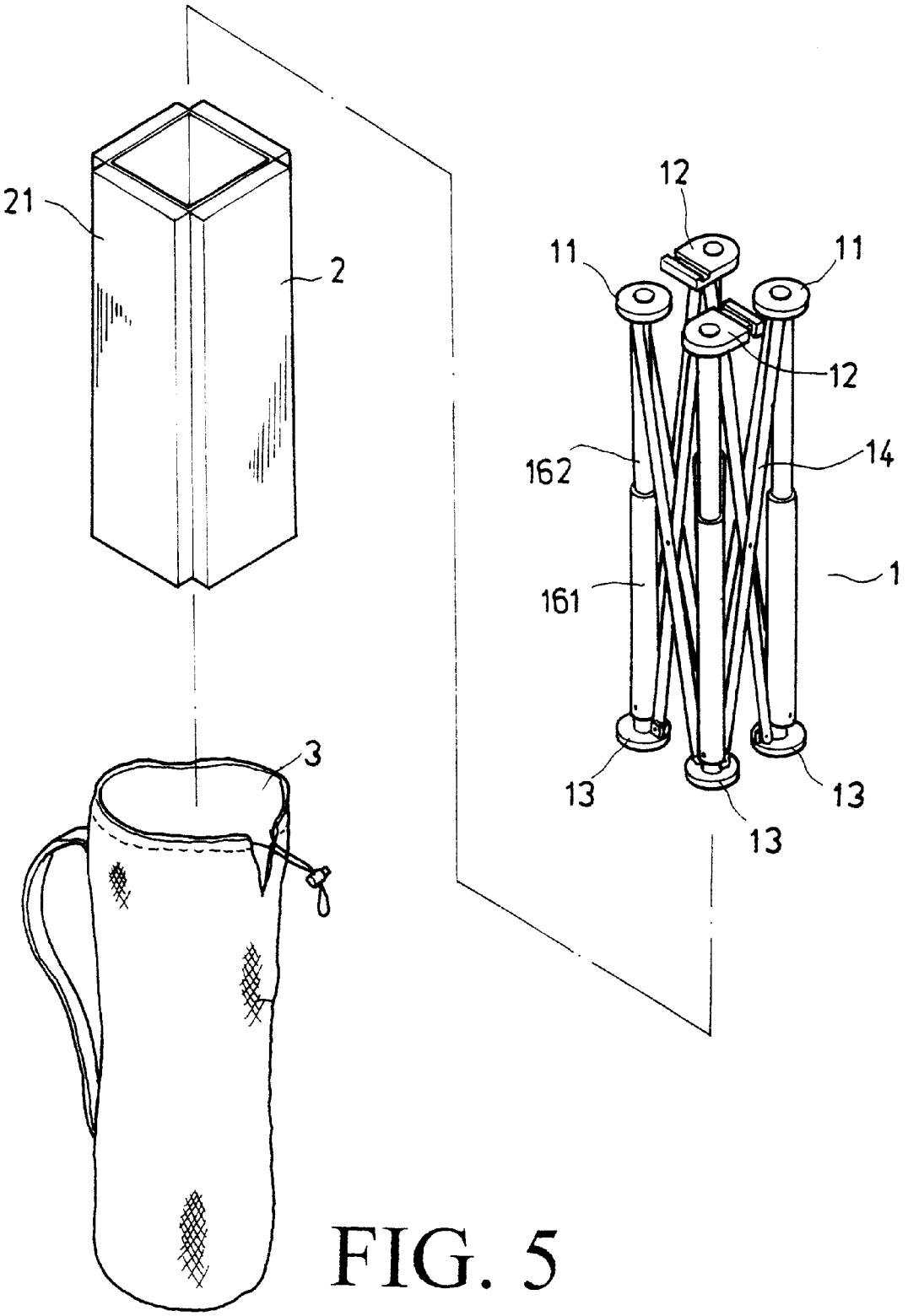
FIG. 5 illustrates the support portion and the tabletop of the collapsible leisure table of FIG. 1 are in fully collapsed state and can be packed in a bag for convenient carriage.

To collapse the leisure table 100, first remove the tabletop 2 from the support portion 1 by disengaging the engaging protrusions 23 from the engaging holes 113, 126 of the locating seats 11, 12. Then lift the links 15 to disengage them from the long grooves 123 on the upper locating seats 12, and push the pivotally connected diagonal struts 14 inward to a collapsed state. At this point, the inner tubes 162 of the telescopic legs 16 connected to the upper locating seats 11, 12 are automatically brought by the collapsed diagonal struts 14 to move upward from the outer tubes 161 to allow the diagonal struts 14 to full collapse. The fully collapsed support portion 1 occupies only a small space, as shown in FIG. 5. The tabletop 2 removed from the support portion 1 may also be easily folded into a hollow case. The collapsed support portion 1 may be positioned in the hollow case formed from the folded tabletop 2. The folded tabletop 2 and the collapsed support portion 1 can therefore be packed in a bag 3 at the same time for convenient storage or carriage.

The collapsible table 100 according to the present invention may be easily and quickly assembled or disassembled by extending or collapsing the intersected and pivotally connected diagonal struts 14 and the telescopic legs 16, and is therefore very suitable for use in outdoor leisure activities.

What is claimed is:

1. A collapsible leisure table comprising a support portion and a tabletop;

said support portion including first and second pairs of upper locating seats, four lower locating seats, four pairs of intersected and pivotally connected diagonal struts, two links, and four telescopic legs each including an outer tube and an inner tube; two of said upper and lower locating seats forming a pair diagonally opposite to one anther; each of said upper locating seats and said lower locating seats being provided at a bottom surface and a top surface, respectively, with a raised portion and a right-angled bracket projected from an outer periphery of said raised portion; said inner tubes of said telescopic legs being connected at upper ends to said raised portions at said bottom surfaces of said upper locating seats and said outer tubes of said telescopic legs being connected at lower ends to said raised portions on said top surface of said lower locating seats; said diagonal struts being connected at upper and lower ends to said right-angled brackets on said upper and said lower locating seats, respectively; said first and said second pairs of upper locating seats are further provided at top surfaces each with an engaging hole, and said second pair of upper locating seats each having an inward extended portion across which a long groove extends, and a notch being formed on each said long groove at an outer end thereof, and that each said link has a first end that being slightly downward bent and is pivotally connected to said right-angled bracket of said first pair of upper locating seats, and a second end that is downward bent by 90 degrees to form a right-angled head such that said links are adapted for separately locating in said long grooves of said second pair of upper locating seats with said right-angled heads firmly hooked at said notches;

whereby when said four pairs of pivotally connected and intersected diagonal struts are in a fully extended state, said inner tubes of said telescopic legs are brought downward by said diagonal struts to be fully received in said outer tubes and said two links are brought to locate in said long grooves on said top surfaces of said second pair of upper locating seats with said right-angled heads of said second ends of said links firmly hooking at said notches at one end of said long grooves to firmly lock said diagonal struts of said support portion in a stably erected state; and said tabletop including four pieces of sequentially and pivotally connected boards that may be fully stretched to provide a plane surface or folded to enclose a hollow space; two of said boards located at two outer sides thereof being formed on a bottom surface at each outer corner with an engaging protrusion corresponding to said engaging holes on said top surfaces of said first and said second pairs of upper locating seats, whereby when both said support portion and said tabletop are fully extended and said links are located in said long grooves and hooked to said notches on said second pair of upper locating seats, said tabletop is positioned on a top of said support portion with said engaging protrusions engaged with said engaging holes to poof complete erection of said collapsible leisure table.

* * * * *